US009020161B2

(12) United States Patent
Horbach

(10) Patent No.: US 9,020,161 B2
(45) Date of Patent: Apr. 28, 2015

(54) SYSTEM FOR HEADPHONE EQUALIZATION

(75) Inventor: Ulrich Horbach, Canyon Country, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 682 days.

(21) Appl. No.: 13/415,536

(22) Filed: Mar. 8, 2012

(65) Prior Publication Data

US 2013/0236023 A1 Sep. 12, 2013

(51) Int. Cl.

| | |
|---|---|
| ***H04R 1/10*** | (2006.01) |
| ***H04R 5/04*** | (2006.01) |
| ***H04R 29/00*** | (2006.01) |
| *H04R 5/033* | (2006.01) |
| *H04R 3/04* | (2006.01) |

(52) U.S. Cl.

CPC ..... *H04R 5/04* (2013.01); *H04R 29/00* (2013.01); *H04R 5/033* (2013.01); *H04R 3/04* (2013.01); *H04R 2420/09* (2013.01); *H04R 2430/03* (2013.01); *H04S 2420/01* (2013.01)

(58) Field of Classification Search

USPC ..... 381/1, 17, 59, 60, 98, 100–104, 309, 381/74, 16; 700/94; 379/428.02

See application file for complete search history.

(56) References Cited

U.S. PATENT DOCUMENTS

| | | | | |
|---|---|---|---|---|
| 4,378,700 | A * | 4/1983 | Flaherty et al. | 73/620 |
| 6,718,034 | B1 * | 4/2004 | Larsen | 379/390.01 |
| 7,587,254 | B2 | 9/2009 | Kirkeby et al. | |
| 8,059,833 | B2 | 11/2011 | Koh et al. | |
| 2011/0191103 | A1 * | 8/2011 | Shin et al. | 704/225 |

FOREIGN PATENT DOCUMENTS

| | | | |
|---|---|---|---|
| JP | 2005309212 | A | 11/2005 |
| WO | 2011026908 | A1 | 3/2011 |
| WO | 2011139502 | A1 | 11/2011 |

OTHER PUBLICATIONS

Lorho et al., "Round Robin Subjective Evaluation of Stereo Enhancement Systems for Headphones," AES 22$^{nd}$ International Conference on Virtual, Synthetic and Entertainment, 10 pgs. Jun. 2002.

Griesinger, David, "Frequency Response Adaptation in Binaural Hearing," AES, Convention Paper 7768, 126$^{th}$ Convention, May 7-10, 2009, Munich, Germany, 11 pgs.

* cited by examiner

*Primary Examiner* — Vivian Chin
*Assistant Examiner* — Friedrich W Fahnert
(74) *Attorney, Agent, or Firm* — Brooks Kushman P.C.

(57) ABSTRACT

A system for headphone equalization includes a stored set of predetermined tone burst reference signals and a stored set of predetermined tone burst test signals that form a range of frequencies used in a user specific audio test to develop a headphone correction filter. A predetermined tone burst reference signal and a predetermined tone burst test signal may intermittently and sequentially drive a transducer included in the headphone. A loudness of the predetermined tone burst reference signal may be fixed and a loudness of the predetermined tone burst test signal may be variable with a gain setting. The gain setting may be used to generate the headphone correction filter.

24 Claims, 15 Drawing Sheets

SYSTEM FOR HEADPHONE EQUALIZATION

BACKGROUND OF THE INVENTION

1. Technical Field

The present invention relates to audio headphones, and more particularly to a system for audio headphone equalization.

2. Related Art

Reproduction of audible sounds using headphones typically entails use of an audio signal generation device that generates one or more audio signals representative of audible sound, such as voice or music, that are provided either via a wire or wireless connection to a headphone. The headphone includes one or more transducers that are positioned in proximity to a user's ears. Audio signals received by the headphone are used to drive the one or more transducers to produce audible sound. In order to provide stereo audible sound, one or more loudspeakers are provided in proximity to each of a user's ears. The headphone may be configured to be inserted in a user's ears, to be positioned on top of a user's ears (supra-aural), or to be surrounding a user's ears (cirumaural).

SUMMARY

A computing system for headphone equalization may use predetermined tone burst reference signals in conjunction with predetermined tone burst test signals during a user specific audio test to generate a headphone correction filter. The headphone correction filter may be applied to audio signals used to drive the headphone transducer(s) to provide equalization of the audio signals. The headphone correction filter may be generated to be headphone specific and user specific to compensate not only for the physical anatomy of the user's ear/hearing and the functionality of the headphone, but also how the user's brain processes the audible sound provided by the headphone.

In an example, the system may include a series of predetermined tone burst reference signals having a fixed loudness level and a series of predetermined tone burst test signals having a variable loudness level. The loudness level of the tone burst test signals may be adjustable based on a respective user gain setting control signal associated with each respective one of the tone burst test signals. The series of tone burst reference signals and the series of tone burst test signals may each be at a different predetermined frequency so that a band of frequencies is formed.

Each of the tone burst reference signals may be associated with a set of tone burst test signals in a sub-band surrounding the frequency of one of the tone burst reference signals. There may be a number of different sub-bands in the frequency band with each containing a tone burst reference signal, and surrounding tone burst test signals. The tone burst test signals in different sub-bands may overlap such that the same tone burst test signals may be used in trials different sub-bands in association with different tone burst reference signals.

Each of the sub-bands includes a series of trials that together may form the user specific audio test. During a first trial in a first sub-band, in a repeating intermittent sequence, a tone burst reference signal may be provided to drive a headphone transducer, followed by a tone burst test signal. A user may listen and compare the two signals, and adjust a loudness of the tone burst test signal until the two signals are perceived by the user as having about equal loudness. Subsequent trials in the first sub-band using the same tone burst reference signal and other tone burst test signals in the first sub-band may be completed until a user gain setting signal has been captured and stored by the system for all the tone burst test signals in the sub-band. This process may be performed for each of the tone burst reference signals in the corresponding other sub-bands.

The resulting captured and stored user gain setting signals from all of the sub-bands may be processed to form a user based frequency response curve. As part of forming the curve, the overlapping user gain signal settings from the tone burst test signals appearing in multiple sub-bands may be interpolated. In addition, the user based frequency response curve may be smoothed and clipped to form a continuous frequency response curve. The frequency response curve may be used by the system to generate the headphone correction filter. Any number of headphone correction filters may be generated, included different headphone correction filters for different headphones and different users.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
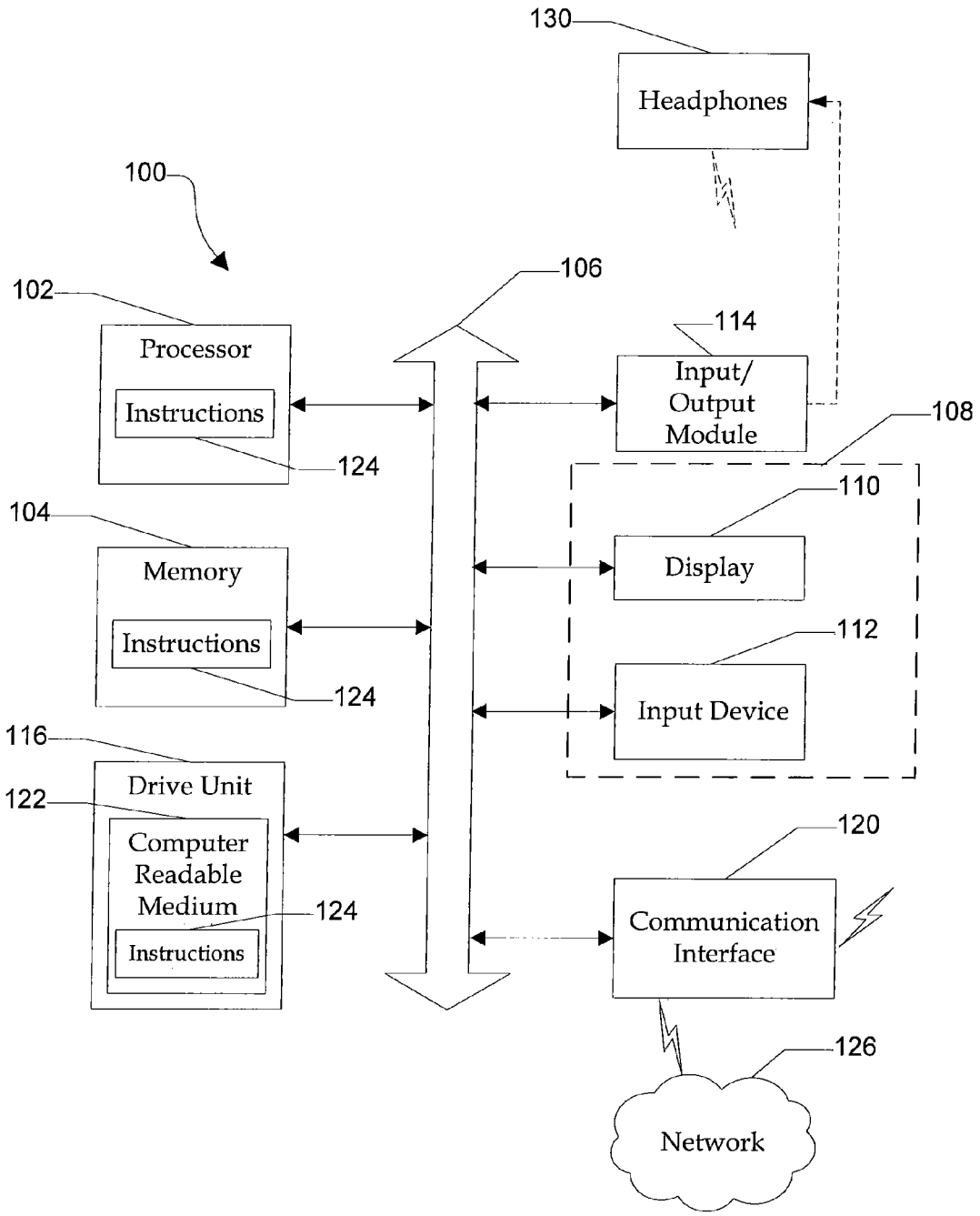
FIG. 1 is an example schematic diagram of a headphone equalization system.

FIG. 1 illustrates an example of a computing system 100. The computing system 100 may operate in the capacity of a server computer, a client user computer in a server-client user network environment, a stand-alone computer, a network based computer and/or any other form of processor based system capable of executing instructions. Any of the components and functionality described may be implemented using all or a portion of the computing system 100. For example, the computing system 100 may include only a processor and memory; only a processor, a memory and a user interface; only a processor, a memory, a user interface and a communication interface; or any other combination of components. In addition, some components and functionality of the computing system 100, which may be being present in the system, have been omitted for purposes of brevity. The computing system 100 can include a set of instructions that can be executed to cause the computing system 100 to perform any one or more of the methods or computer based functions described. The computing system 100 may operate as a standalone device or may be connected, e.g., using a network, to other computer systems or peripheral devices.

The computing system 100 can also be implemented as or incorporated into various devices, such as a personal computer (PC), a tablet PC, a personal digital assistant (PDA), a mobile device, a palmtop computer, a laptop computer, a desktop computer, a communications device, a wireless telephone, an audio device, or any other machine capable of executing a set of instructions (sequential or otherwise) that specify actions to be taken by that machine. Examples of audio devices include an amplifier, a compact disc player, a television, a vehicle head unit, a radio, a home theater system, an audio receiver, an MP3 player, an audio headphone, an IPOD, or any other device capable of generating audio signals and/or audible sound perceived by a listener. In a particular example, the computing system 100 can be implemented using wireless electronic devices such as a smartphone that provide voice, audio, video or data communication. Further, while a single computing system 100 is illustrated, the term "system" shall also be taken to include any collection of systems or sub-systems that individually or jointly execute a set, or multiple sets, of instructions to perform one or more computer functions.

In FIG. 1, the example computing system 100 may include a processor 102, that may operate as a central processing unit (CPU), a graphics processing unit (GPU), and/or a digital signal processor (DSP). The processor 102 may be a component in a variety of systems. For example, the processor 102 may be part of a wireless device, or a standard personal computer or a workstation. The processor 102 may include or be one or more general processors, digital signal processors (DSP), application specific integrated circuits, field programmable gate arrays, digital circuits, analog circuits, combinations thereof, or other now known or later developed devices for analyzing and processing data. The processor 102 may execute a software program, such as code or instructions generated manually (i.e., programmed).

The term "module" may be defined to include a plurality of executable modules. As described herein, the modules are defined to include software, hardware or some combination of hardware and software that is executable by a processor, such as processor 102. Software modules may include instructions stored in memory, such as memory 104, or another memory device, that are executable by the processor 102 or another processor. Hardware modules may include various devices, components, circuits, gates, circuit boards, and the like that are executable, directed, and/or controlled for performance by the processor 102.

The computing system 100 may include a memory 104, such as a memory 104 that can communicate via a communication bus 106. The memory 104 may be a main memory, a static memory, or a dynamic memory. The memory 104 may include, but is not limited to computer readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like. In one example, the memory 104 includes a cache or random access memory for the processor, 102. In alternative examples, the memory 104 is separate from the processor 102, such as a cache memory of a processor, the system memory, or other memory. The memory 104 may include or be an external storage device or database for storing data. Examples include a hard drive, compact disc ("CD"), digital video disc ("DVD"), memory card, memory stick, floppy disc, universal serial bus ("USB") memory device, or any other device operative to store data. The memory 104 is operable to store instructions executable by the processor 102. The functions, acts or tasks illustrated in the figures or described may be performed by the programmed processor 102 executing instructions stored in the memory 104. The functions, acts or tasks are independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

The memory 104 may be a computer readable storage medium. The term "computer-readable storage medium" may include a single medium or multiple media, such as a centralized or distributed database, and/or associated caches and servers that store one or more sets of instructions. The term "computer-readable storage medium" may also include any medium that is capable of storing, encoding or carrying a set of instructions for execution by a processor or that cause a computer system to perform any one or more of the methods or operations disclosed. The "computer-readable storage medium" may be non-transitory, and may be tangible.

The computing system 100 may also include a user interface 108. In FIG. 1, the user interface 108 includes a display module 110 and an input module 112. In other examples, one of the display module 110 or the input module 112 may be omitted. The display module 110, may include any form of visual rendering device, such as a liquid crystal display (LCD), an organic light emitting diode (OLED), a flat panel display, a solid state display, a cathode ray tube (CRT), a projector, or other now known or later developed display device for outputting determined information. The display module 110 may act as an interface for the user to see the functioning of the computing system, and/or as an interface with the software stored in the memory 104 or in the drive unit 116.

The input module 112 may be configured to allow a user to interact with any of the components of the computing system 100. The input module 112 may include a number pad, a keyboard, or a cursor control device, such as a mouse, or a joystick, touch screen display capabilities, voice command capabilities, remote control or any other device or capability operative to interact with the computing system 100.

The computing system 100 may also include an input/output module 114 configured to receive and provide input and output signals. The input and output signals may be analog or digital signals provided individually, or within a protocol such as RS232, RS484, Universal Serial Bus (USB), FIREWIRE, AES, or any other protocol.

In a particular example, as depicted in FIG. 1, the computing system 100 may also include a disk, solid state, or optical drive module 116. The disk drive module 116 may include a computer-readable medium 122 in which one or more sets of instructions 124, such as software, can be embedded. Further, the instructions 124 may embody one or more of the methods or logic as described. In a particular example, the instructions 124 may reside completely, or at least partially, within the memory 104 and/or within the processor 102 during execution by the computing system 100. The memory 104 and the processor 102 also may include computer-readable media as discussed above.

The present disclosure contemplates a computer-readable medium that includes instructions 124 or receives and executes instructions 124 responsive to a propagated signal so that a device connected to a network 126 can communicate voice, video, audio, images or any other data over the network 126. Further, the instructions 124 may be transmitted or received over the network 126 via a communication port or interface 120, and/or using a communication bus 106. The communication bus 106 may be any form of communication pathway between the modules of the computing system 100, which may include dedicated communication pathways and/or shared communication pathways, and may or may not use a communication protocol for communication. The communication port or communication interface 120 may be a part of the processor 102 or may be a separate component. The communication port 120 may be created in software or may be a physical connection in hardware. The communication port 120 may be configured to connect with a network 126, external media, the display 110, or any other components in system 100, or combinations thereof. The connection with the network 126 may be a physical connection, such as a wired Ethernet connection or may be established wirelessly. Likewise, the additional connections with other components of the system 100 may be physical connections or may be established wirelessly, such as using a BLUETOOTH, or other short range wireless protocol. The network 126 may alternatively be directly connected to the communication bus 106.

The network 126 may include wired networks, wireless networks, Ethernet AVB networks, or combinations thereof. The wireless network may be a cellular telephone network, an 802.11, 802.16, 802.20, 802.1Q or WiMax network. Further, the network 126 may be a public network, such as the Internet, a private network, such as an intranet, a local area network, a wide area network, or combinations thereof, and may utilize a variety of networking protocols now available or later developed.

The system is not limited to operation with any particular standards and protocols. For example, standards for Internet and other packet switched network transmission (e.g., TCP/IP, UDP/IP, HTML, HTTP) may be used. Such standards are periodically superseded by faster or more efficient equivalents having essentially the same functions. Accordingly, replacement standards and protocols having the same or similar functions as are considered equivalents.

Applications that may include the system may broadly include a variety of electronic and computer systems. One or more examples described may implement functions using two or more specific interconnected hardware modules or devices with related control and data signals that can be communicated between and through the modules. Accordingly, the present system encompasses software, firmware, and hardware implementations. The system described may be implemented by software programs executable by a computer system. Further, in a non-limited example, implementations may include distributed processing, component/object distributed processing, and parallel processing. Alternatively, virtual computer system processing, such as cloud computing, may be constructed to implement various parts of the system.

The computing system 100 may be in communication with headphone 130. The headphone 130 may include at least a pair of transducers that are positioned to be in close proximity to one or more of a listener's ears when the headphones are worn by the listener. The headphones 130 may be circumaural to encompass a listener's ears, supra-aural to sit on top of a listener's ears, ear-fitting, such as earbuds and in-ear designs, or any other design that provides an individual listening experience to a user. In addition or alternatively, the headphone 130 may be a headset used by a user for both listening and speaking.

The headphone 130 may be in communication with the computing system 100 via a wired or a wireless communication. For example, the headphones 130 may be in wired communication with the computing system 100 via a cable and the input/output module 114 or the network 126, or in wireless communication with the computing system 100 via the communication interface 120 or the network 126. In some example applications, at least a portion of the computing system 100 may be resident in the headphone 130. In other examples, at least part of the computing system 100 may be in a separate device, such as a mobile communication device or audio player, and headphone 130 may be a separate standalone device.

The computing system 100 may provide accurate individualized headphone equalization without test microphones or other expensive equipment by providing a listener test procedure that results in user personalized equalization settings for a particular set of headphones. The user personalized equalization signals are derived by the computing system 100 using a testing procedure initiated by the user. During the test procedure, predetermined previously stored sets of test signals and reference signals are presented to the user via the headphone 130. Based on the users feedback collected and stored during the testing procedure, the computing system 100 may generate a headphone correction filter that is customized for the particular user and a particular set of headphones. The headphone correction filter may be a digital filter, or an analog filter that is applied to audio signals such that filtered audio signals drive the transducers in the headphone 130.

The computing system 100 may provide audio signals to drive the headphone 130 based on pre-recorded audio content or live audio content, such as music or voice. The audio signals may be digital or analog audio signals. Pre-recorded audio content can include stored audio content, streaming audio content, or any other audio content that is captured and recreated. Live audio content can include conversations, musical performances, or any other audible sound being supplied at the time of production of the audible sound as an audio signal. Alternatively, or in addition, audio signals to drive the headphones may be provided from an audio device, such as an MP3 player, an audio codec, a CD or DVD player, or any other device capable of producing audio signals to drive the transducer(s) in the headphone 130. Where an audio device is used to provide audio signals to drive the headphone 130, the headphone correction filter may be applied to the audio signals at the audio device; at an intermediary point, such as the computing system 100 or a separate filter device; or at the headphone 130.

Any number of headphone correction filters may be generated by the computing system 100. Thus, a user may have different digital headphone correction filters for different sets of headphones and different audio devices.

The computing system 100 may generate one or more headphone correction filters so that the headphone 130 can provide high quality sound reproduction. It is important for high quality sound reproduction that the sound transducers themselves (headphone loudspeakers) deliver the program material in a neutral way, without imposing any audible frequency response alteration. In general, it is difficult to measure and determine perceived frequency responses of headphones. One of the problems with headphone reproduction is the large coloration, variation from headphone device to device, and differences in perceived audio sound timbre from one listener to another.

Measured headphone data (binaural data), using a coupler or dummy head, are difficult to interpret and of limited value for accurate headphone equalization (EQ) because measured headphone date does not take individually perceived frequency responses and variations among listeners into account. The computing system 100 provides a simple, convenient means to capture and then equalize the response for an individual user in the form of one or more headphone correction filters. Due to the testing method employed, not only do the headphone correction filters generated by the computing system 100 take into account the anatomical conditions of a listener's ears, but also how the listener's brain processes audible sound received in the listener's ears. Thus, the headphone correction filters generated by the computing system 100 may correct pre-filtering of stereo signals for the headphones 130, in order to obtain flat perceived responses and as a result, correct out-of-head localization with binaural recordings, or other stereo material that has been processed through head-related (binaural) filters.

Variations of perceived responses among listeners using the same headphone can be significant. Hence a fixed, predefined EQ filter intended for use with all listener's will likely work poorly for some listeners, reasonable for other listeners, and well for some other listeners. The computing system 100 may generate headphone EQ filters (correction filters) that are individually adapted to each person, without, for example performing test measurements with a probe microphone while wearing the headphone. If such tests were undertaken, a probe microphone could be inserted into the ear canal to detect sound pressure, very close to the ear drum. Problems with this testing technique are listener safety, cost, variations of the test microphone's frequency response itself, and its influence on the response while inserted in the listener's ear. Further, in these types of tests, it is not clear how closely the response resembles the actual listener's perceived response, because further "filtering" of information in the brain is not taken into account.

The computing system 100 solves these types of problems by applying predetermined test signals, such as pre-equalized, equal-loudness burst signals during a user specific tuning test. In other examples, the predetermined test signals may be pseudo-random noise, windowed sine bursts, or any other bandlimited signals. The burst signals may be derived from impulse responses of a predetermined auditory filter bank. The audio band may be divided into sub-bands with different reference frequencies (fref) substantially centered in each band, thereby avoiding large pitch differences between the test signals. Overlapping regions of each of the frequency sub-bands may be used to ensure that a frequency response curve over the entire desired frequency range can be reconstructed reliably. In addition, the overlapping regions of the frequency sub-bands can be used to confirm consistency of the user inputs captured and stored during the user specific audio test. The computing system 100 may employ an automatic filter design method that takes captured and stored user input data and generates headphone correction filters, or headphone EQ filters.

Figure 2:
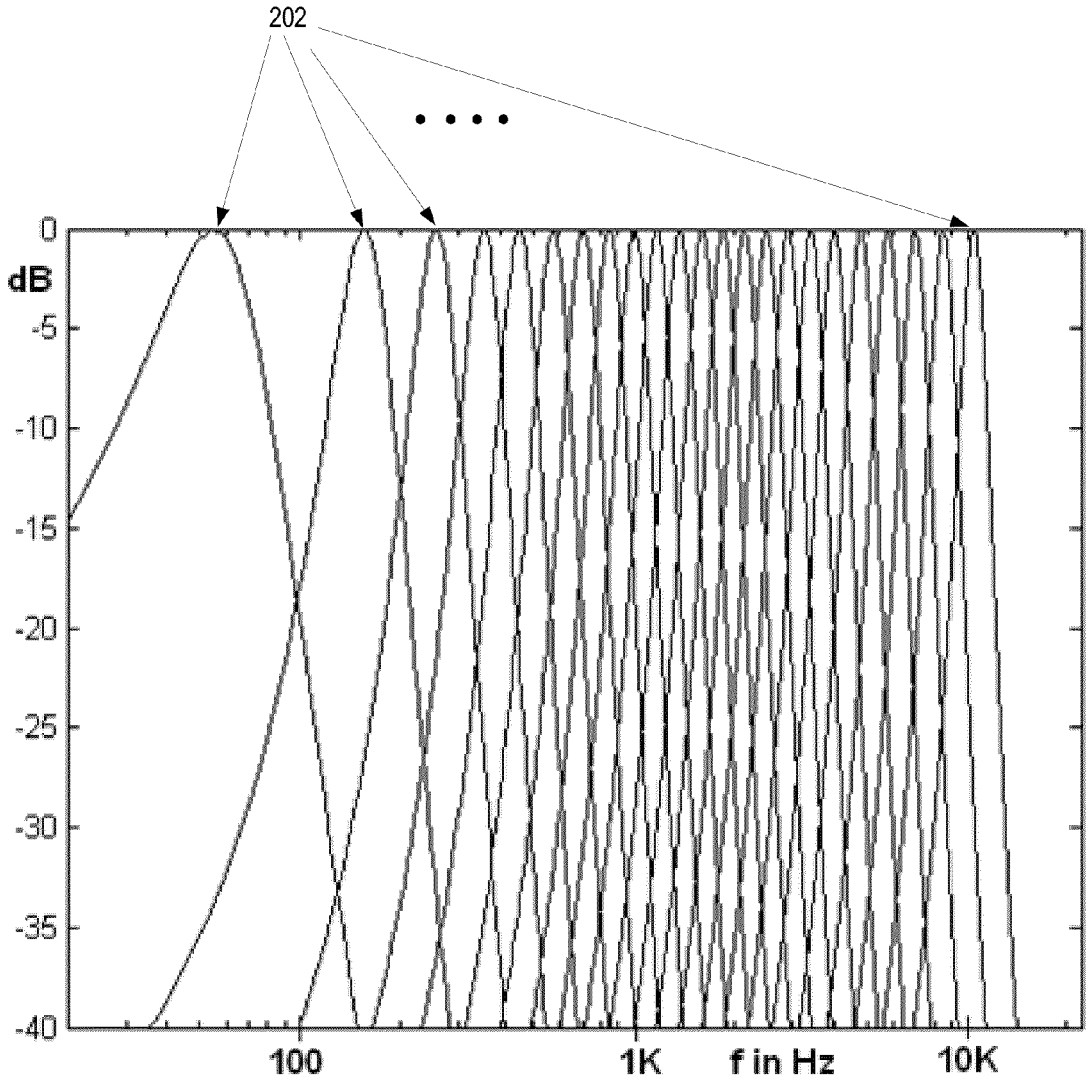
FIG. 2 is an example of an audio filter bank having a predetermined number of auditory frequency ranges.

FIG. 2 is an example of an audio filter bank generated by the computing system 100. The filter bank may be generated using software toolbox, such as a Matlab software toolbox to have a predetermined number of auditory frequency ranges. The filter bank may be generated to resemble the resolution of human hearing. In FIG. 2, the filter bank is a 23-band auditory filter bank (or ERB=Equivalent Rectangular Bandwidth filter bank). The filter bank may be generated with a number of predetermined auditory frequency ranges chosen with the goal of minimizing the number of trials (loudness comparisons) performed by a user to generate the headphone correction filters. Center frequencies (fc) 202 of each of the band filters may be at predetermined frequencies. In FIG. 2, there are twenty-three "critical band" center frequencies (fc) 202:

fc [1:23]=[50 150 250 350 450 570 700 840 1000 1170 1370 1600 1850 2150 2500 2900 3400 4000 4800 5800 7000 8500 10500] Hz

In other examples, fewer or greater numbers of center frequencies may be generated for the band filters.

Figure 3:
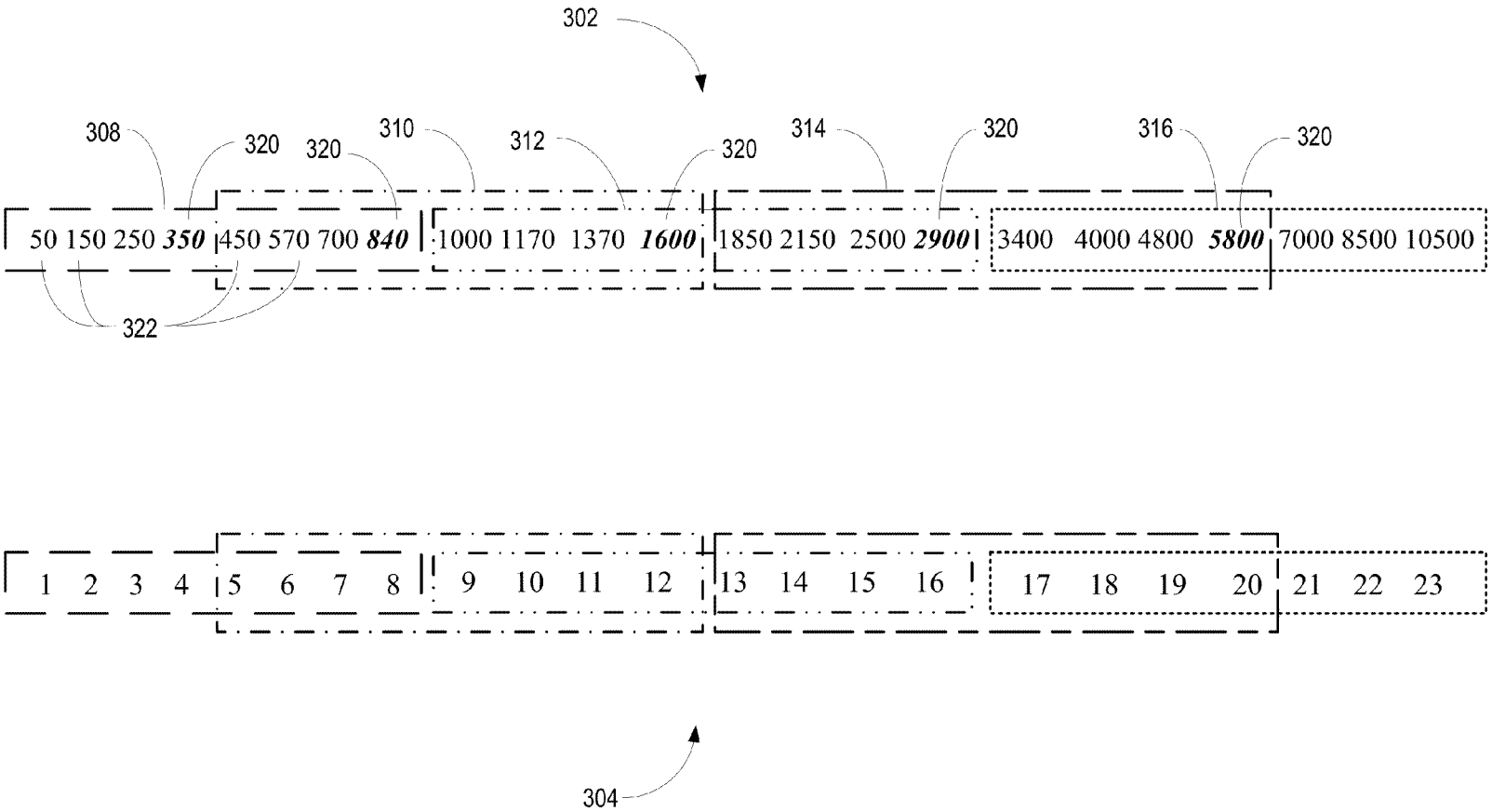
FIG. 3 is an example of trial sets of center frequencies (fc) included in the auditory frequency ranges of audio filter bank of FIG. 2.

FIG. 3 is an example of the center frequencies (fc) divided into sub-bands of frequencies that are trial sets used in performing a user specific audio test. In FIG. 3, the band of center frequencies 302 are illustrated adjacent to a corresponding indexing chart 304 of numbered index locations of each center frequency (fc) across a frequency spectrum from 50 Hz to 10.5 kHz. The band of center frequencies 302 may be divided into five sub-bands that includes a first sub-band 308, a second sub-band 310, a third sub-band 312, a fourth sub-band 314 and a fifth sub-band 316. Within each of the sub-bands is a tone burst reference signal 320 (fref), which is a center frequency (fc) chosen as a centrally located reference frequency within a respective sub-band. In addition, a plurality of test frequencies which are center frequencies (fc) of tone burst test signals 322 (tefr) may be positioned at audible test frequencies that surround the tone burst reference signal (fref) 320 forming a trial set in each of the sub-bands.

For example, in FIG. 3 in the first sub-band 308, the tone burst reference signal 320 (.fref) is in index location 4 at a frequency of 350 Hz, and the tone burst test signals 322 (tefr) are in index locations 1, 2, 3 and 5, 6, 7, 8, at corresponding frequencies of 50 Hz, 150 Hz, 250 Hz, 450 Hz, 570 Hz, 700 Hz, and 840 Hz to form the surrounding trial set. Also in FIG. 3, in another example, in the second sub-band 310, the tone burst reference signal 320 (fref) is in index location 8 at a frequency of 840 Hz, and the tone burst test signals 322 (tefr) are in index locations 5, 6, 7, and 9, 10, 11, 12 at corresponding frequencies of 450 Hz, 570 Hz, 700 Hz, 1000 Hz, 1170 Hz, 1370 Hz, and 1600 Hz to form the surrounding trial set. In still another example, in the third sub-band 312, the tone burst reference signal 320 (fref) is in index location 12 at a frequency of 1600 Hz, and the tone burst test signals 322 (tefr) are in index locations 9, 10, 11, 13, 14, 15, and 16 at corresponding frequencies of 1000 Hz, 1170 Hz, 1370 Hz, 1850 Hz, 2150 Hz, 2500 Hz, and 2900 Hz to form the surrounding trial set. In the example of the fourth sub-band, the tone burst reference signal 320 (fref) is in index location 16 at a frequency of 2900 Hz, and the tone burst test signals 322 (tefr) are in index locations 13, 14, 15, 17, 18, 19, and 20 at corresponding frequencies of 1850 Hz, 2150 Hz, 2500 Hz, 3400 Hz, 4000 Hz, 4800 Hz, and 5800 Hz to form the surrounding trial set. In the example of the fifth sub-band 316, the tone burst reference signal 320 is in index location 20 at a frequency of 5800 Hz, and the tone burst test signals 322 are in index locations 17, 18, 19, 21, 22 and 23 at corresponding frequencies of 3400 Hz, 4000 Hz, 4800 Hz, 7000 Hz, 8500 Hz, and 10500 Hz to form the surrounding trial set. In other examples, there may be fewer or additional sub-bands, and the frequencies included in each of the trial sets of frequencies in each of the sub-bands may be different.

Each of the trial sets 308, 310, 312, 314, or 316 may be stored as a set of predetermined tone burst reference signals and a set of predetermined tone burst test signals that can be used during the user specific tuning test. As illustrated in FIG. 3, there are overlapping frequencies in each of the sub-bands so that the same frequencies appear in different trial sets. During the user specific tuning test, the stored tone burst reference signal 320 (fref) and the stored tone burst test signals 322 (tefr) are sequentially and intermittently presented to the listener. The tone burst reference signal 320 (fref) and the tone burst test signals 322 (tefr) are each provided as audible sounds to the listener via the headphones. As used herein, the term "signal" or "signals" are used to describe electrical signals representative of audible sound that used to drive transducers, or audible sound produced by the transducers as a result of being driven by electrical signals representative of audible sound. In one example, the tone burst reference signal 320 (fref) and the tone burst test signals 322 (tefr) are time-domain test signals formed as gated, minimum phase impulse responses of the band filters. The audible sound produced with the reference and test signals may be an audible tone produced in the respective center frequencies (fc). Alternatively, or in addition, the audible sound produced with the reference and test signals may be bandlimited random noise, windowed sine burst signal with Gaussian or other windows, or any other form of audible sound.

The tone burst reference signal 320 (fref) and the tone burst test signals 322 (tefr) may be played in a predetermined sequence, with predetermined periods of silence between the signals. In one example, the periodic sequence is:

fref [i]→pause 1 →tefr [i]→pause 1 →fref [i]→pause 2 fref [i]→pause 1 →tefr [i]→pause 1 →fref [i]→pause 2.

The tone burst reference signal 320 (fref) operates as a reference signal with a fixed level, followed by one of the tone burst test signals 322 (tefr) having a level that is adjustable by the listener. The periodic sequence may also include a first pause (pause 1) between the signals, and a second pause (pause 2) at the end of the periodic sequence before the next periodic sequence commences. The sequence may be repeated periodically. In one example, the first pause (pause 1) may be about 0.2 seconds, and the second pause (pause 2) may be about 0.4 seconds. In other examples, different lengths of time may be used for the first and second pauses, and/or the first and second pauses may be the same length of time, or different lengths of time.

During each periodic sequence, a user may listen to the tone burst reference signal 320 (fref) at one center frequencies (fc) followed by one of the tone burst test signals 322 (tefr) in the sub-band played at another center frequencies (fc) and compare the perceived loudness of the two signals. The user may then adjust the loudness of the tone burst test signal 322 (tefr). Differences in loudness between the tone burst reference signal 320 (fref) and the tone burst test signal 322 (tefr) are related to differences in sound pressure level (SPL) and duration of the different audible sounds due to the human auditory system integrating or averaging the effect of SPL over a window of time, such as a 600 to 1000 millisecond window. Adjustment of the loudness of the tone burst test signal 322 (tefr) may be performed manually by the listener during each periodic sequence to equalize the loudness of the reference and test signals. In response to a user adjustment, a user gain setting signal may be received by the computing system 100. When the listener is satisfied that the perceived loudness of the tone burst reference signal 320 (fref) and the tone burst test signal 322 (tefr) are substantially the same, the listener may proceed to the next trial in the sub-band using the same tone burst reference signal 320 (fref) and a different one of the tone burst test signals 322 (tefr). Upon sequentially completing a comparison of the tone burst reference signal 320 (fref) to all of the tone burst test signals 322 (tefr) in the sub-band, and capture and storage of the respective gain setting signals from corresponding gain settings used to equalize the loudness, the computing system 100 may repeat the procedure for the next trial set.

Figure 4:
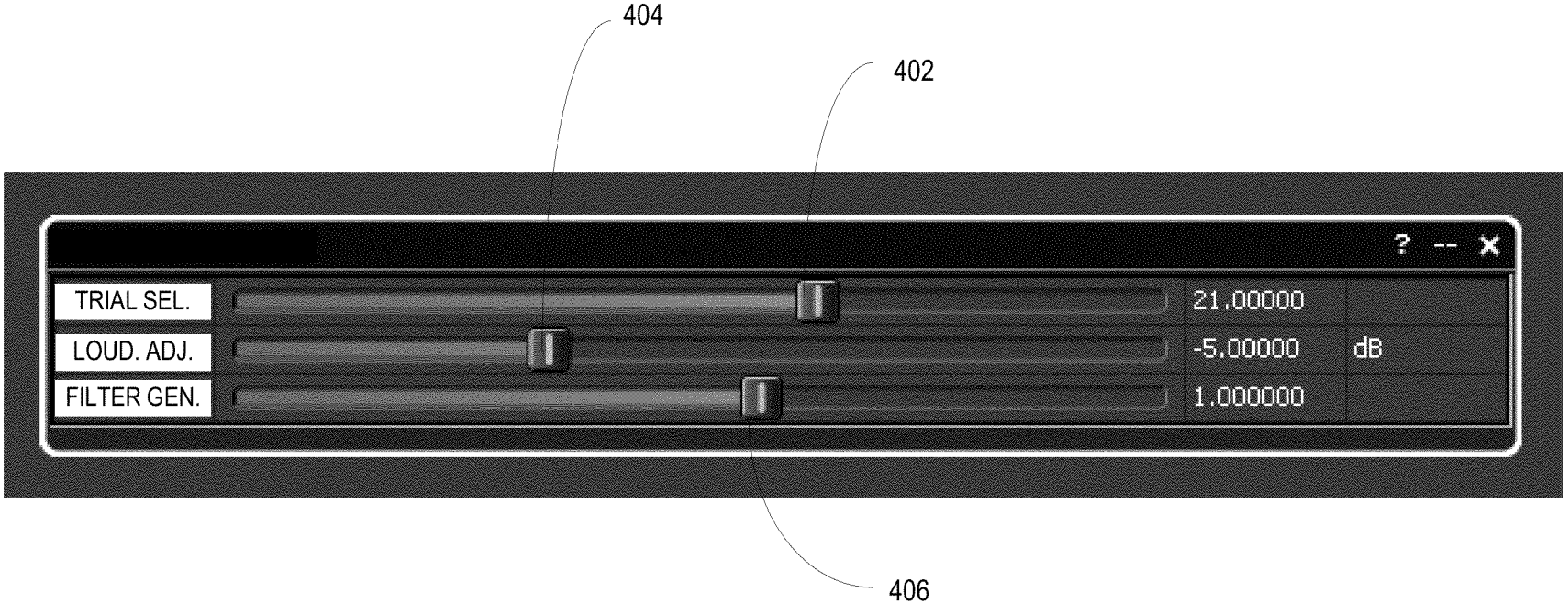
FIG. 4 is an example of a user interface for use in a user specific audio test.

FIG. 4 is an example user interface that a listener may use to complete the user specific tuning test. The user interface may include a trial selector 402, a loudness adjustment 404 and a filter generator 406. The trial selector 402 may provide a user with the ability to sequence through the available trials. Thus, when a listener has completed a trial, the user may provide a trial complete signal to the computing system via the user interface to proceed to the next trial (trial t+1) in the sequence. In response to trial complete signal, the computing system may store the results of the present trial, and initiate the next trial in the trial sequence. In addition, or alternatively, the listener may select a next trial, such as by selection of a trial number, which may not be next in a sequence.

The loudness adjustment 404 may be used to adjust the loudness of the tone burst test signal 322 (tefr) presently being used in the selected trial. Adjustment of the loudness may be performed by the computing system by changing a gain associated with the tone burst test signal 322 (tefr) to adjust an amplitude of the tone burst test signal 322 (tefr). The gain may be adjusted in response to receipt of a loudness adjustment signal or user gain setting signal from the user interface. Thus, as the user adjusts the loudness adjustment, a corresponding gain setting signal may be received by the computing system. The gain setting signal may be captured and stored by the computing system. In addition, the gain setting signal may adjust a gain being applied to the tone burst test signal 322 (tefr) to raise or lower the loudness of the signal. In one example, the amplitude of the tone burst test signals 322 (tefr) may be adjusted in an adjustment range of −15 dB to +15 dB with the loudness adjustment 404. In other examples, any other range of adjustment may be used.

The received gain setting signal may be captured and stored in association with the tone burst test signal 322 (tefr) presently being used in the selected trial. Where the same trial is performed multiple times using the same tone burst test signal 322 (tefr), the received gain setting signal may overwrite a previously received gain setting signal. Thus, a user may perform the same trial multiple times within a single user specific audio test, while having only a single gain setting signal captured and stored for each respective one of the tone burst test signals 322 (tefr). Upon moving to another trial during the user specific audio test, the last captured and saved gain setting signal may be used.

The filter generation module 406 may provide a filter generation signal, such as a start flag from the user interface. In response to receipt of the filter generation signal, the computing system may complete the trial presently in progress, and store the results. In addition, a filter design process may be initiated, as explained later.

In FIG. 4, the user interface is illustrated as a graphical user interface touchscreen display containing sliders for each of the trial selector 402, the loudness adjustment 404 and the filter generator 406. In other examples, any other form of user interface, such as buttons, knobs, sliders, or any other mechanism allowing a listener to provide a corresponding signal may be used. Variable or state change mechanisms may be used for each of the trial selector 402, the loudness adjustment 404, and the filter generator 406. For example, the trial selector 402 and the loudness adjustment 404 may use a variable device such as a rotary knob to provide a respective signal indicative of a linearly changeable value, whereas the filter generation module 406 may use a state change such as a switch or a button to initiate filter generation. In FIG. 4, the trial selector 402 is a slider providing an index value signal (i) between i=1 and i=34, since, in this example, there are 34 trials divide among five trial sets, the loudness adjustment 404 is a slider that may be moved along a continuum from −15 dB to +15 dB, and the filter generator 406 may be moved from a left position to a right position to initiate the filter design process.

With reference to FIG. 3, an example of a sequence of trials [i] included in a series of trial sets (sub-bands) forming a user specific tuning test are:

*fref* [*i*] = [4 4 4 4 4 4 4] (first trial set 308) …

[8 8 8 8 8 8 8] (second trial set 310) …

[12 12 12 12 12 12 12] (third trial set 312) …

[16 16 16 16 16 16 16] (fourth trial set 314) …

[20 20 20 20 20 20 20] (fifth trial set 316);

where the values in [bracket] denote the index location of the filter bank center frequencies fc that are the reference signal (tone burst reference signal 320 (fref)) used throughout the respective trial set. In this example, the filter bank center frequencies fc that are corresponding test signals (tone burst test signals 322 (tefr)) used in the trials in each of the trial sets are:

*tefr* [*i*] = [1 2 3 4 5 6 7 8] (first trial set 308)

[5 6 7 8 9 10 11 12] (second trial set 310)

[9 10 11 12 13 14 15 16] (third trial set 312)

[13 14 15 16 17 18 19 20] (fourth trial set)

[17 18 19 20 21 22 23] (fifth trial set 316);

where the values in [bracket] denote the index location of the filter bank center frequencies fc that are the test signals (tone burst test signals 322 (tefr)) used throughout the respective trial sets.

As previously discussed, each of the trial sets include overlapping trials in which the filter bank center frequencies (fc) that are test signals are re-used with different filter bank center frequencies (fc) used as the reference signal. In the previous example, three test signals are repeated in the other trial sets. For example, trials using index locations 5, 6 and 7 as test signals are repeatedly used in the first and second trial sets. In addition, at least one of the tone burst test signals 322 (tefr) in one trial set may be the tone burst reference signal 320 (fref) in another trial set. For example, the tone burst test signal 322 (tefr) at 840 Hz in the trial set of the first sub-band 308 may be the tone burst reference signal 320 (fref) in the trial set of the second sub-band 310. Use of the same test signals in multiple trials sets should ideally lead to the same result (loudness level) by independent listener adjustment of the loudness level of the same test signals when compared to different reference signals. This overlapping data may be used to align the resulting individual curves to a frequency response curve representative of the entire trial.

Figure 5:
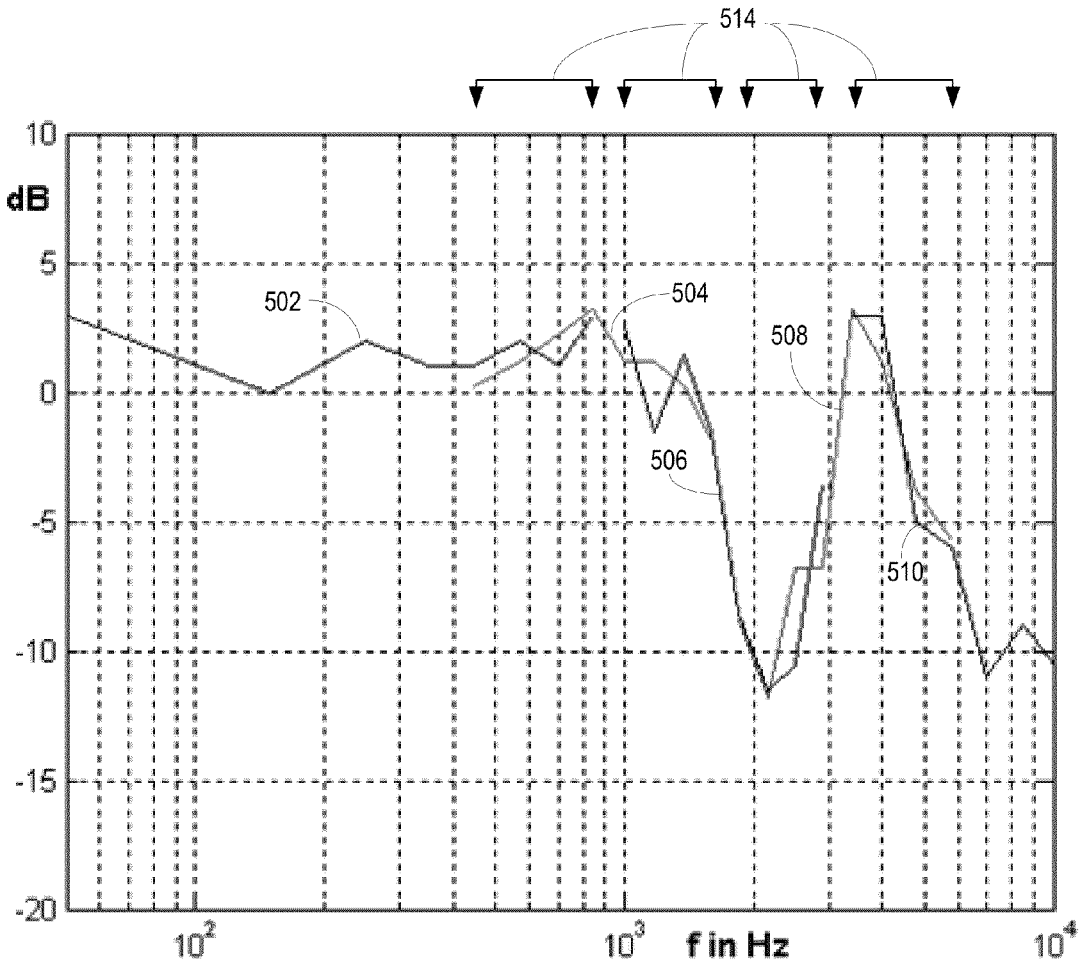
FIG. 5 is an example of user gain settings captured and stored during a series of trials performed in a user specific audio test.

FIG. 5 is an example interpolated frequency response curve based on a user based frequency response curve representing an entire user specific audio test. In FIG. 5, a first segment 502 of the curve represents user gain settings from the first trial set 308 in a range of 50 Hz to 840 Hz, applied to the filter bank center frequencies (fc) in index locations 1-8. A second segment 504 of the curve represents user gain settings from the second trial set 310 in a range of 450 Hz to 1600 Hz, applied to the filter bank center frequencies (fc) in index locations 5-12. A third segment 506 of the curve represents the user gain settings from third trial set 312 in a range of 1000 Hz to 2900 Hz, applied to the filter bank center frequencies (fc) in index locations 9-16. A fourth segment 508 of the curve represents user gain settings from the fourth trial set 314 in a range of 1850 Hz to 5800 Hz, applied to the filter bank center frequencies (fc) in index locations 13-20. A fifth segment 510 of the curve represents user gain settings from the fifth trial set 316 in a range of 3400 Hz to 10500 Hz, applied to the filter bank center frequencies (fc) in index locations 17-23.

An overlap 514 of the different segments is illustrated in FIG. 5 over respective frequency ranges corresponding to the overlapping test signals. Within the overlapping frequency ranges the two different segments should include substantially the same level of loudness following adjustment by the listener of the gain of the corresponding test signals during the respective trial sets. Indication of substantially the same level of gain adjustment for the test signals in different trial sets may be used to confirm accuracy of the test results. A predetermined gain variability threshold, such as +/−3 dB, may be used to confirm accuracy of the test results. In the event the variability of the gain values of the same test signals in two different trial sets, exceeds the gain variability threshold, the computing system may generate an indication to the listener, such as, an indication of inaccurate results, and/or an indication that the user specific tuning test must be repeated for the effected segments (trials or trial sets), or the entire test.

Referring again to FIGS. 2 and 3, the test signals are impulse responses of the filter bank's band filters that are provided in a window of predetermined period of time based on the respective trial set under test. The windows of time may be identified by a number of frequency bins, such as a number of fast Fourier transform (FFT) bins, where the frequency bins are derived from a predetermined sample rate, and a predetermined number of samples. The window of time (or pulse length) for each of the burst tones included in a tone burst test signal 322 (tefr) in a trial may be dependent on the trial set under test. In one example, the pulse length of the burst tones in the respective trial sets may be:

*win1* [*i*] = [*w1* *w1* *w1* *w1* *w1* *w1* *w1*] (first trial set 308)

[*w2* *w2* *w2* *w2* *w2* *w2* *w2*] (second trial set 310)

-continued

[ w3 w3 w3 w3 w3 w3 w3 ] (third trial set 312)

[ w3 w3 w3 w3 w3 w3 w3 ] (fourth trial set 314)

[ w4 w4 w4 w4 w4 w4 w4 ] (fifth trial set 316);

where w1=4096 frequency bins; w2=2048 frequency bins; w3=1024 frequency bins; and w4=512 frequency bins. In other examples, any other length of window, sample rate, and number of samples may be used. Each of the burst tones may be repeated a predetermined number of times within the tone burst test signal 322 (tefr) depending upon the trial set within which the trial is located. In one example the burst tone may be repeated pern[i] times during each tone burst test signal 322 (tefr) of a trial in a respective trial set:

*pern* [*i*] [ 1 1 1 1 1 1 1 ] (first trial set 308)

[ 2 2 2 2 2 2 2 ] (second trial set 310)

[ 4 4 4 4 4 4 4 ] (third trial set 312)

[ 4 4 4 4 4 4 4 ] (fourth trial set 314)

Figure 6:
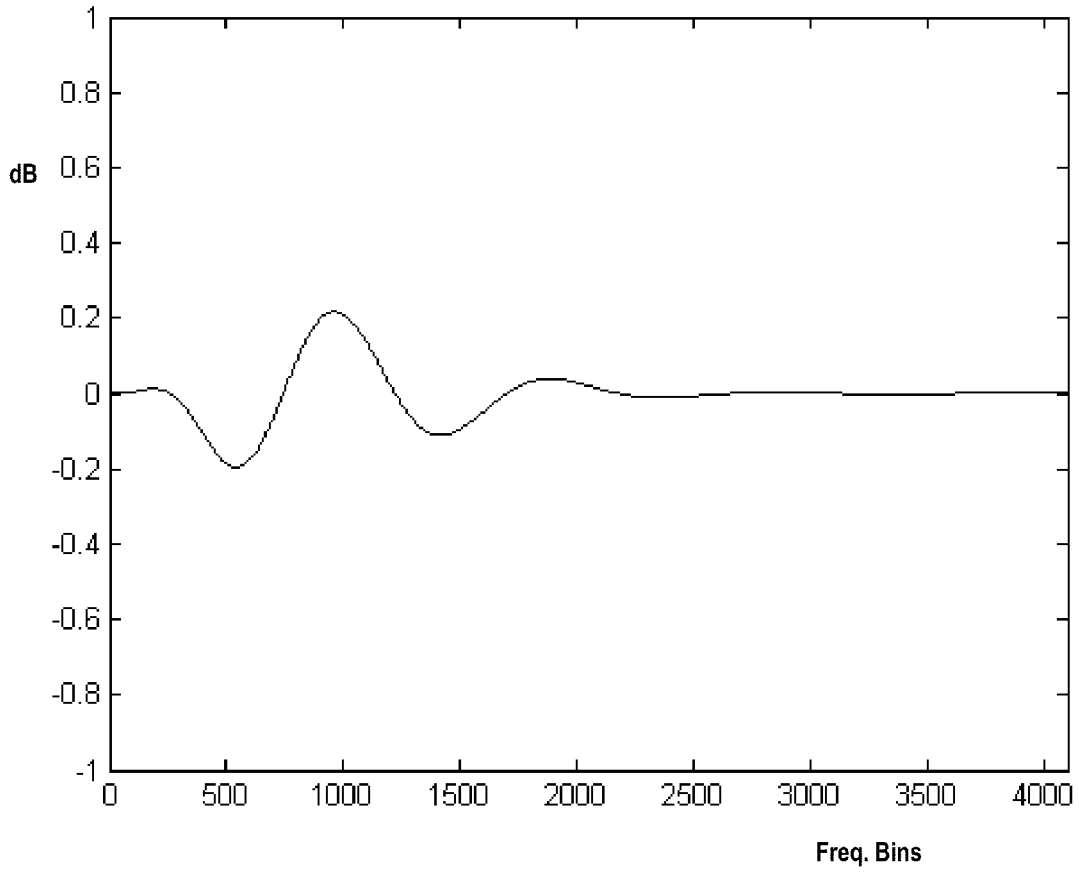
FIG. 6 is an example of a 50 Hz excitation burst signal.
Figure 7:
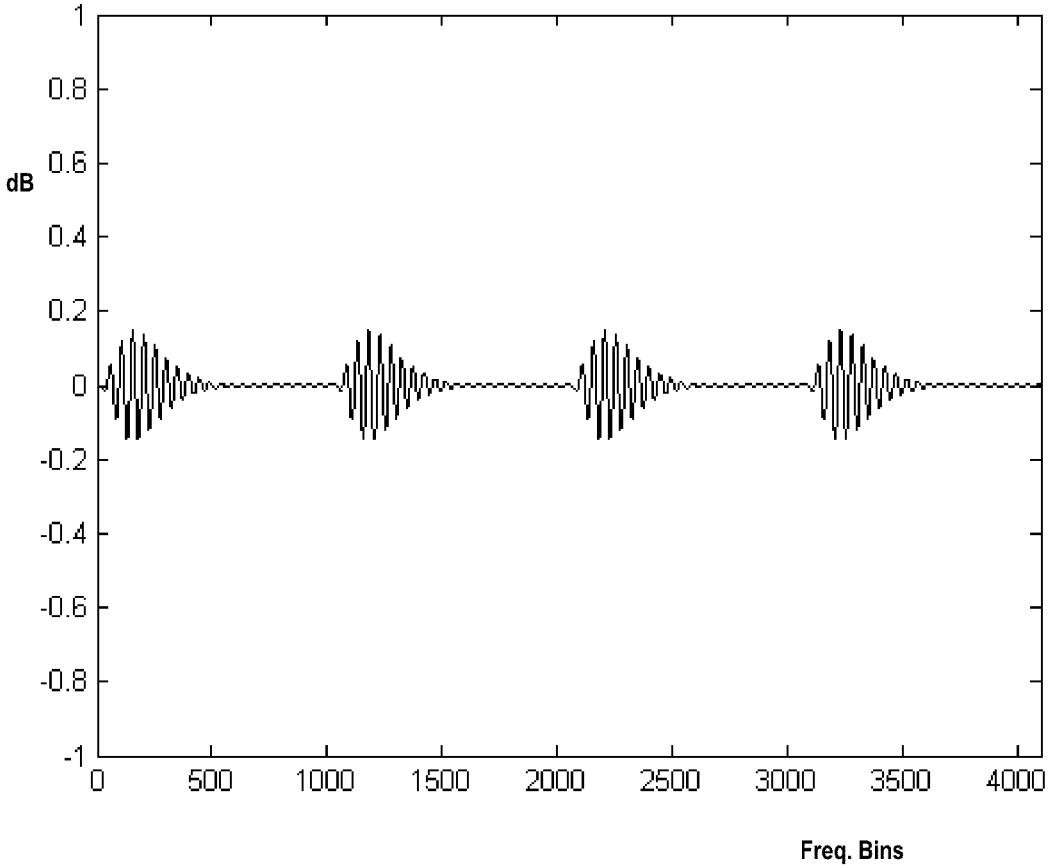
FIG. 7 is an example of a 1 KHz excitation burst signal.
Figure 8:
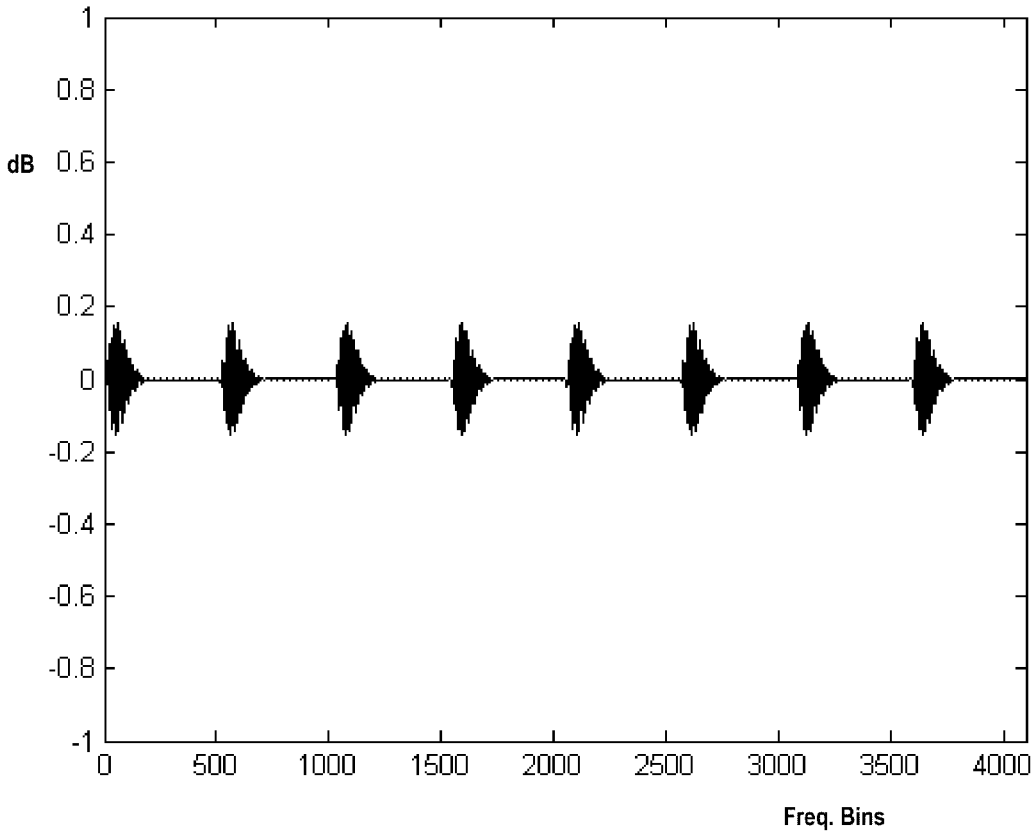
FIG. 8 is an example of a 3.4 KHz excitation burst signal.
Figure 9:
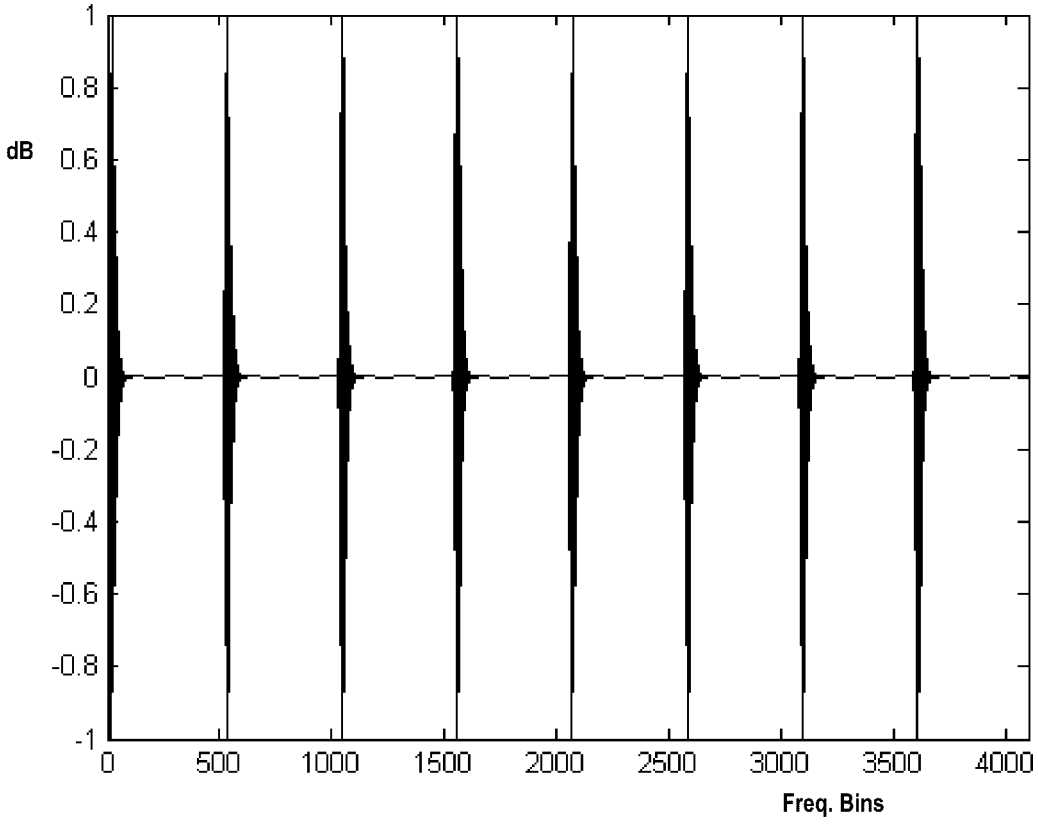
FIG. 9 is an example of a 10.5 KHz excitation burst signal.

[ 8 8 8 8 8 8 8 ] (fifth trial set 316);

FIG. 6 illustrates an example of a 50 Hz test signal included in the first trial set 308, in which the window (w1) is 4096 bins in length, and a single excitation burst signal (pern) occurs within the tone burst test signal 322 (tefr). FIG. 7 illustrates an example of a 1 KHz test signal included in the third trial set 312, in which the window (w3) is 1024 bins in length, and four excitation burst signals (pern) occur within the tone burst test signal 322 (tefr). FIG. 8 illustrates an example of a 3.4 KHz test signal included in the fifth trial set 316, in which the window (w4) is 512 bins in length, and eight excitation burst signals (pern) occur within the tone burst test signal 322 (tefr). FIG. 9 illustrates an example of a 10.5 KHz test signal included in the fifth trial set 316, in which the window (w4) is 512 bins in length, and eight excitation burst signals (pern) occur within the trial. In other examples, the length of the test pulses and the number of test pulses included in an excitation burst signals (pern) may be different.

All of the excitation burst signals may be pre-filtered by the computing system using an equal-loudness filter prior to storage and use in the test signals. Alternatively, the tone burst test signals 322 (tefr) which include the excitation burst signals, may be pre-filtered by the computing system using the equal-loudness filter prior to storage and use as the test signals In some examples, the loudness filtered excitation burst signals may be stored as a set of predetermined tone burst reference signals. In other examples, the tone burst test signal 322 (tefr) may be created using the filtered excitation burst signals and stored as a set of predetermined tone burst test signals. Alternatively, or in addition, the equal loudness filter may be applied to the excitation burst signals prior to the excitation burst signals being provided to the computing device for storage. Thus, the equal loudness filter may or may not be stored within the computing system, and the filtered, or unfiltered sets of predetermined tone burst reference and test signals may be stored.

Figure 10:
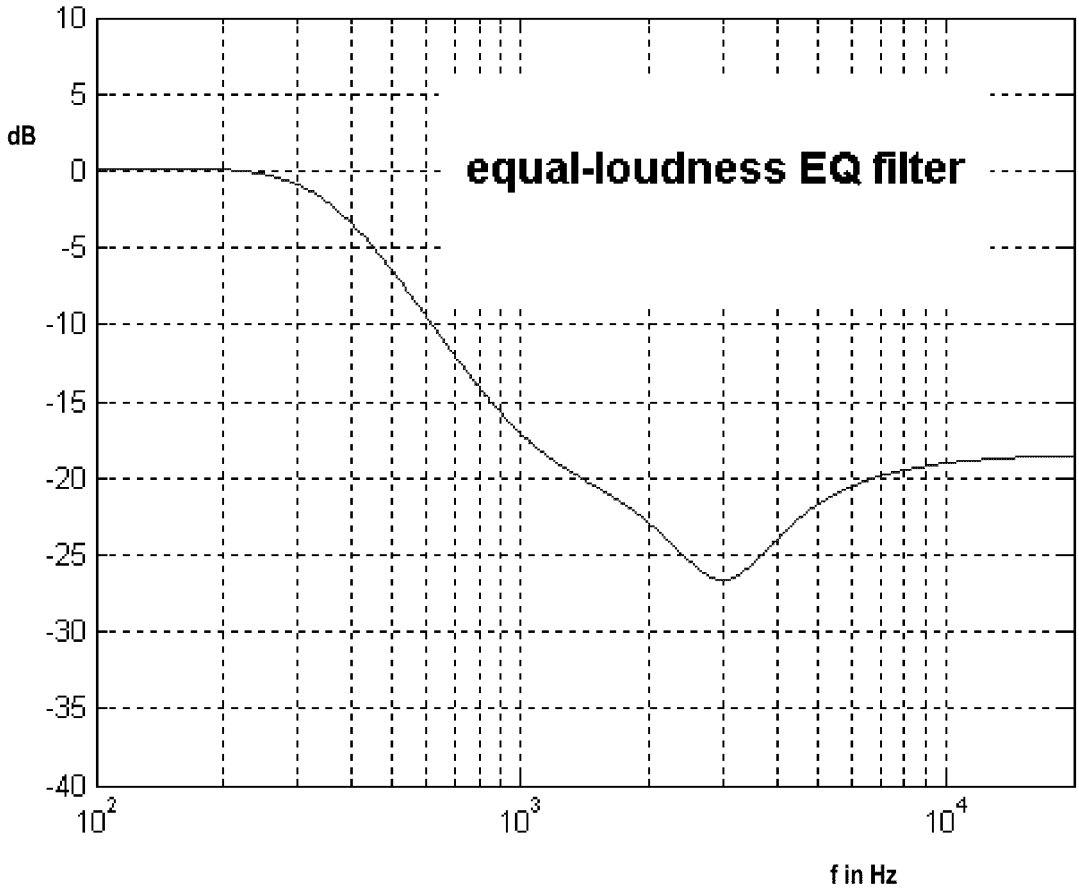
FIG. 10 is an example of a frequency response of an equal-loudness EQ filter.

FIG. 10 is an example equal-loudness filter designed to pre-filter the excitation burst signals or the tone burst test signals 322 (tefr). The equal-loudness filter may be determined empirically to ensure equal loudness of the test bursts. In one example, the equal-loudness filter may be empirically determined using a frontal reference loudspeaker with a known flat frequency response, where a listener adjusts the test signals to equal loudness. In another example, the equal-loudness filter may be empirically determined by applying trial procedures to a set of different high-quality headphones, then subtracting a common bias curve from the measured responses.

The equal loudness filter may comprise a cascade of two second-order filter sections. In one example, the equal loudness filter may be specified to include a first filter section and a second filter section. The first filter section may include a notch filter, and the second filter section may include a shelving filter. In the example of a notch filter, the notch may be a second order infinite impulse response filter with a notch occurring at about 3 KHz. In this example the shelving filter may provide boost at low frequency by providing a shelving curve between about 200 Hz and 1000 Hz. Accordingly, in this example, the parameters of the first and second filter sections may be:

First Filter Section: Notch filter at notch frequency fcn=3000 Hz; Q-factor Qn=0.7; gain agn=−8 [dB];

The numerator polynomial bn and denominator an can be computed with the following Matlab sequence (fs=sample rate):

```
K=tan(pi*fcn/fs);

vgn=10^(agn/20);

u=1+K/Qn+K^2;

bn=[1+vgn/Qn*K+K^2, 2*(K^2-1), 1-vgn/Qn*K+
    K^2]/u;

an=[1, 2*(K^2-1)/u, (1-K/Qn+K^2)/u];
```

Second Filter Section: Shelving filter with fc=350; again=−18.5; Q=0.8;

```
K=tan(pi*fc/fs);

vg=10^(again/20);

u=l+K/Q+K^2;

bn=[vg+sqrt(vg)/Q*K+K^2, 2*(K^2-vg), vg-sqrt(vg)/
    Q*K+K^2]/u;

an=[1, (2*(K^2-1))/u, (1-K/Q+K^2)/u];
```

In other examples, third order or higher order recursive filters may be used. In addition, the filters may be other than recursive filters, or may include different parameters that substantially meet the functional criteria described. Further, finite impulse response filters may be used instead of, or in addition to infinite impulse response filters.

Figure 11:
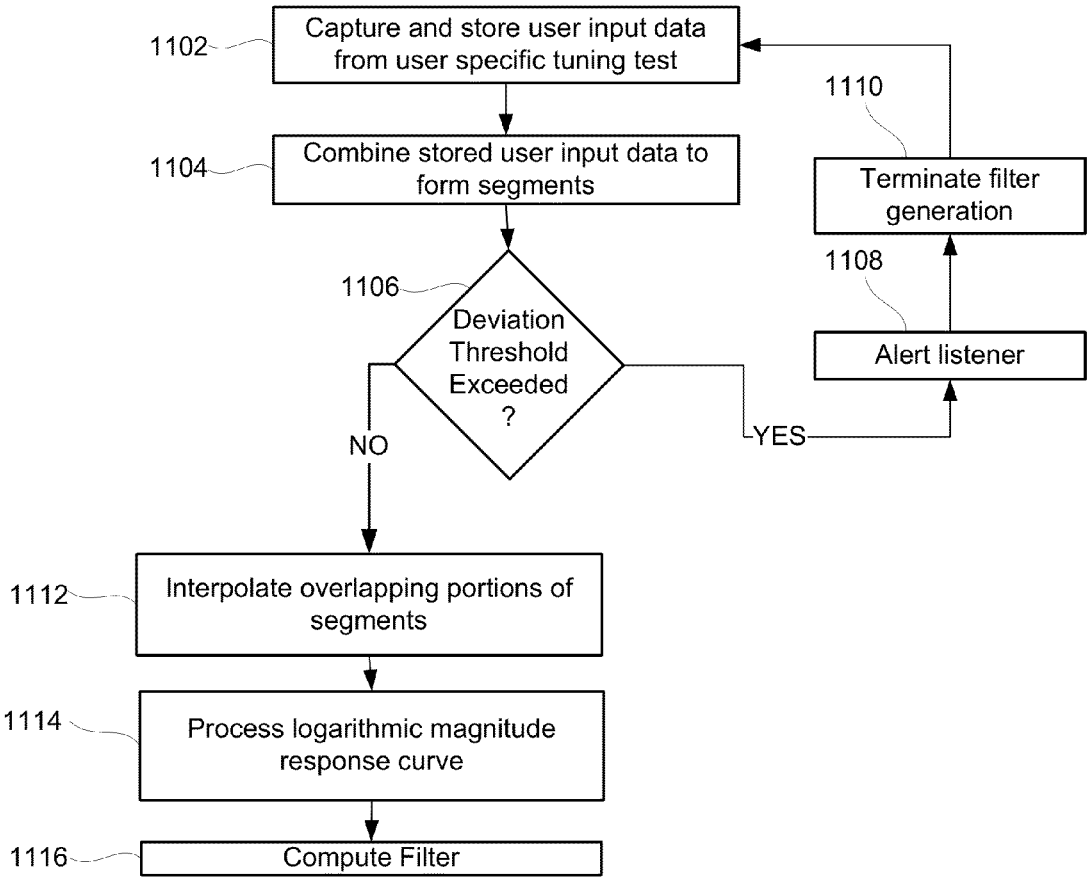
FIG. 11 is an example operational flow diagram for generating a headphone correction filter from a user specific audio test.

The raw filter data entered by the listener as gain adjustments and captured by the computing system may be used to create the segments of FIG. 5. From the raw filter data, the computing system 100 may calculate the headphone equalization filter. FIG. 11 is an example operational flow diagram illustrating generation of a headphone equalization filters. In other examples different, greater, and/or fewer steps may be used to generate the headphone equalization filters.

At block 1102, pieces of user input data in the form of gain values from each of the trials in the trial sets included in the user specific tuning test are captured and stored n memory. At block 1104, the stored user input data is combined to form the segments 502, 504, 506, 508, and 510, as previously discussed with regard to FIG. 5. Deviation of the test signal gains for overlapping portions of the segments may be compared to a gain deviation threshold at block 1106. If the gains deviate above the threshold, the listener may be alerted at block 1108. At block 1110, the computing system may terminate the generation of the headphone equalization filter, and the process may return to block 1102 to capture and store user input data during a subsequent user specific tuning test.

If, on the other hand, the deviation in the gains is determined by the computing system to be within the gain deviation threshold at block 1106, the operation proceeds to block 1112 where the overlapping portions of the segments may be interpolated to a fine frequency grid in order to form a continuous logarithmic magnitude response curve of the gain values. At block 1114 the logarithmic magnitude response curve may be processed to create a continuous frequency response curve used to generate a filter. In one example, the logarithmic magnitude response curve may be normalized, limited to a maximum allowed gain if necessary, and smoothed to form the continuous frequency response curve. At block 1116 a headphone correction filter may be computed by the computing system from the continuous frequency response curve. In one example, the computing system may compute a final finite impulse response (FIR) filter from the continuous frequency response curve for the headphone correction filter.

Figure 12:
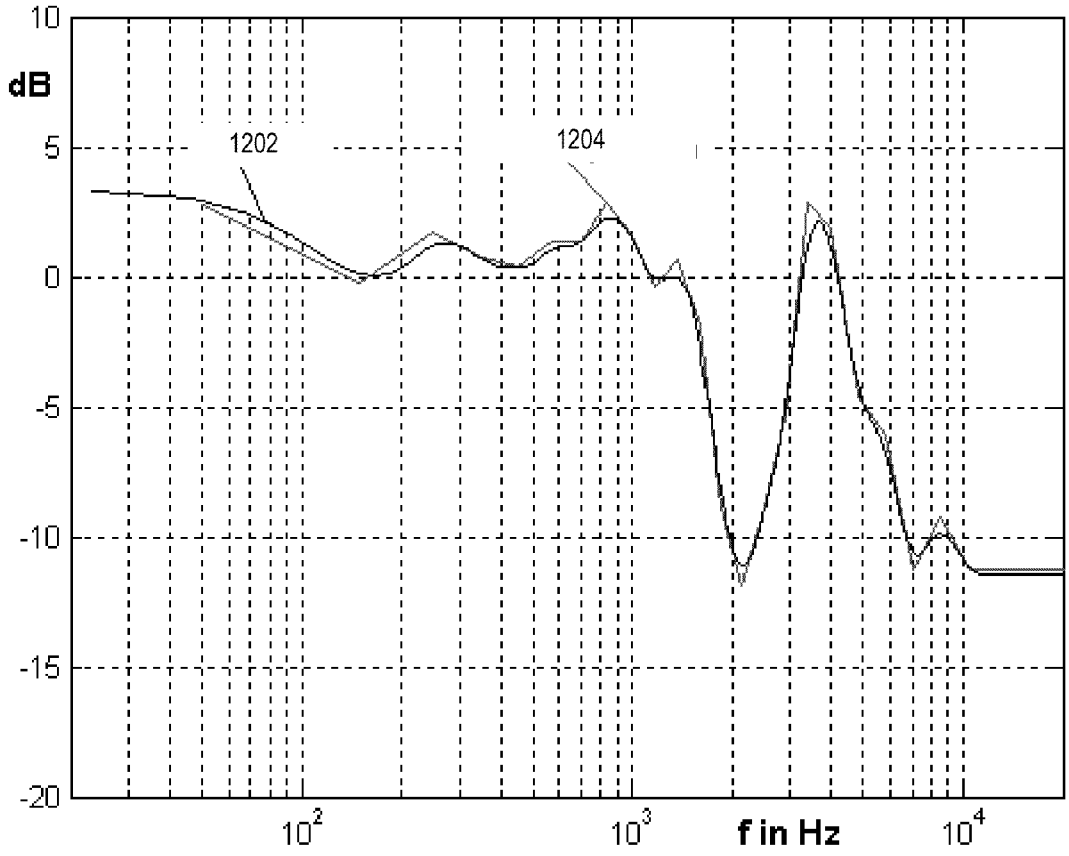
FIG. 12 illustrates example processed frequency based user gain settings from a user specific audio test, and an example filter response of a corresponding headphone correction filter.

FIG. 12 is an example of a frequency response curve 1202 generated by the process described with reference to FIG. 11, and a continuous frequency response curve 1204. The continuous frequency response curve 1204 may be an interpolated, gain limited and smoothed logarithmic magnitude response representative of the listener gain inputs captured and stored during the user specific tuning test. The frequency response curve 1202 may be for an FIR filter developed using, for example, a Hilbert transform method. In this example, a filter length of the filter may typically be about 256 . . . 1024 frequency bins.

Figure 13:
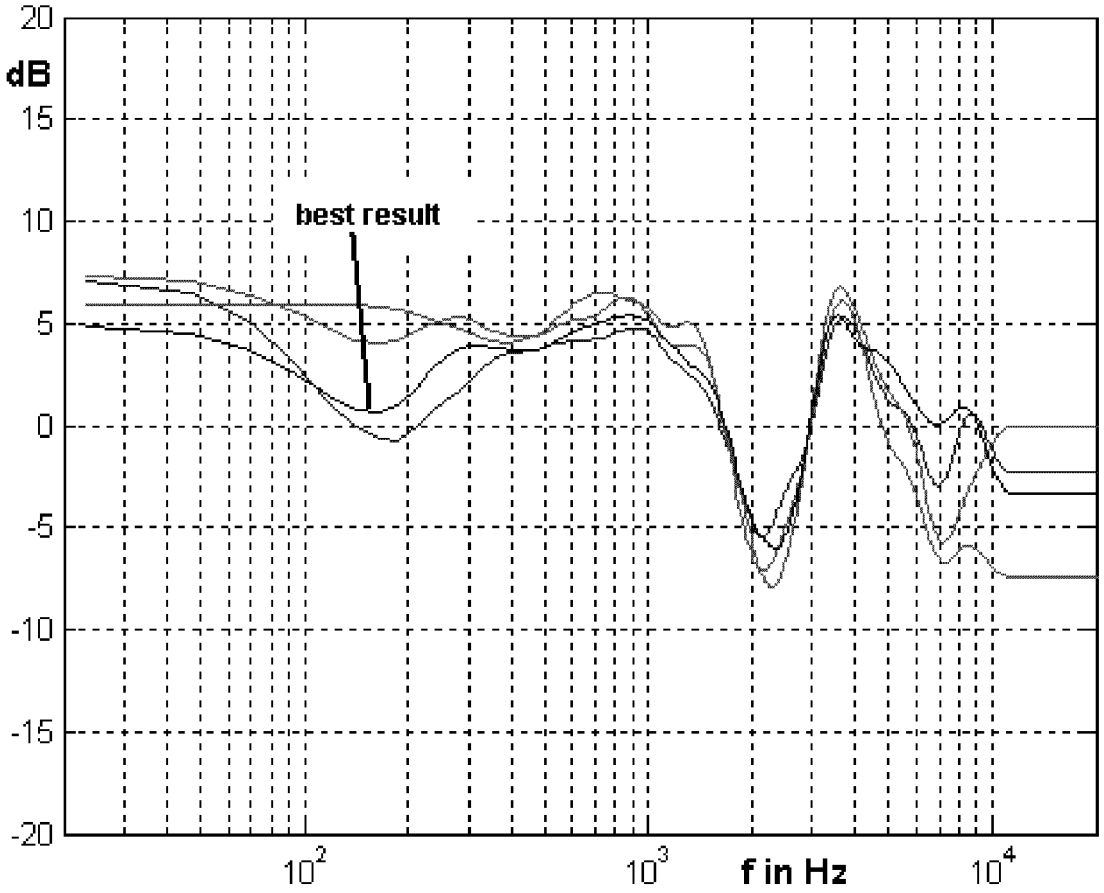
FIG. 13 is an example of a family of filter response curves of respective head phone correction filters generated by a single user from repeated user specific audio tests of a same headphone.

FIG. 13 is an example of various frequency response curves for corresponding audio correction filters that were generated by the same user and the same headphone but at different times. As previously discussed, a listener can perform multiple user specific tuning tests and generate a corresponding headphone correction filter as an outcome of each test. In FIG. 13, there is dispersion between the different filter response curves for corresponding headphone correction filters. Based on subjective listening tests, the user may select one of the headphone correction filters for use in the headphone that delivers the "best" sonic results based on the user's subjective opinion. The selected headphone correction filter may be stored for use in the audio signal source, an intermediate audio processing device, or in the headphone. As a result to the subjective listener testing, it can be established that all the headphone correction filters sound better than the headphone without any equalization.

Figure 14:
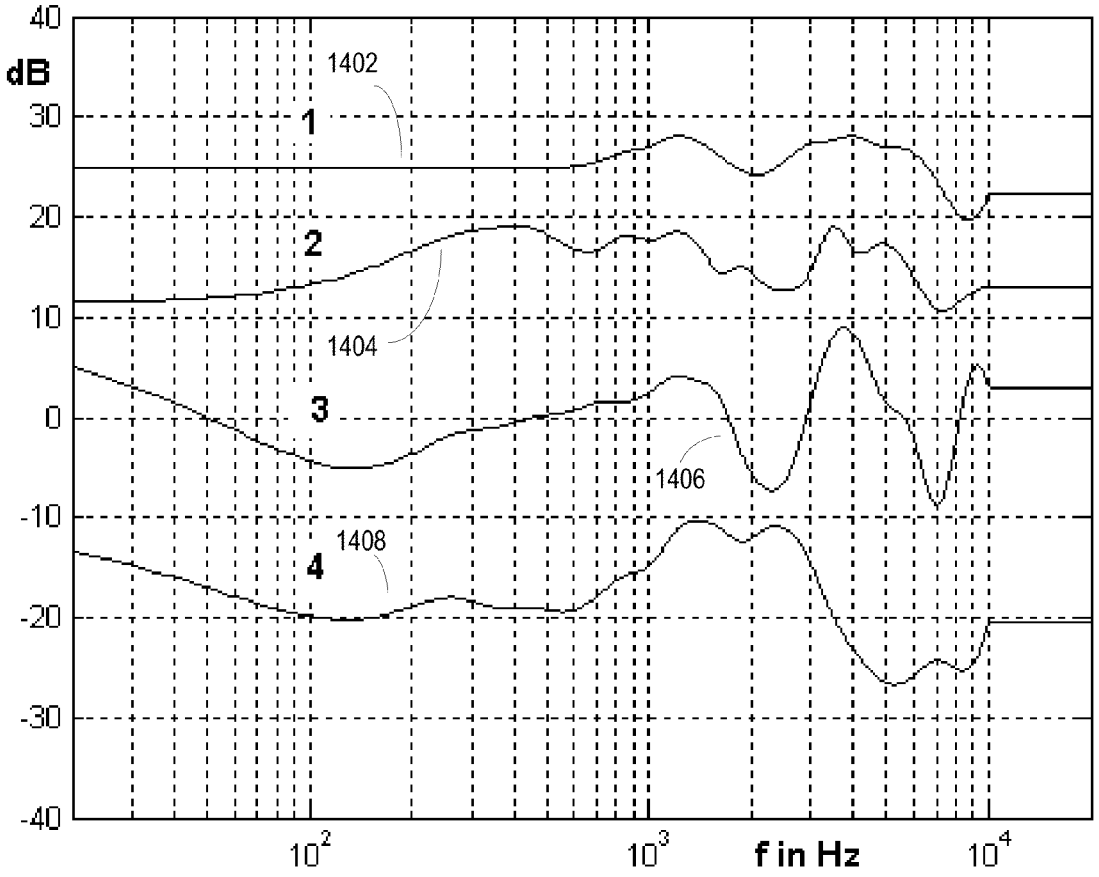
FIG. 14 is an example of filter response curves of respective head phone correction filters generated by a single user from user specific audio tests of a number of different headphones.
Figure 15:
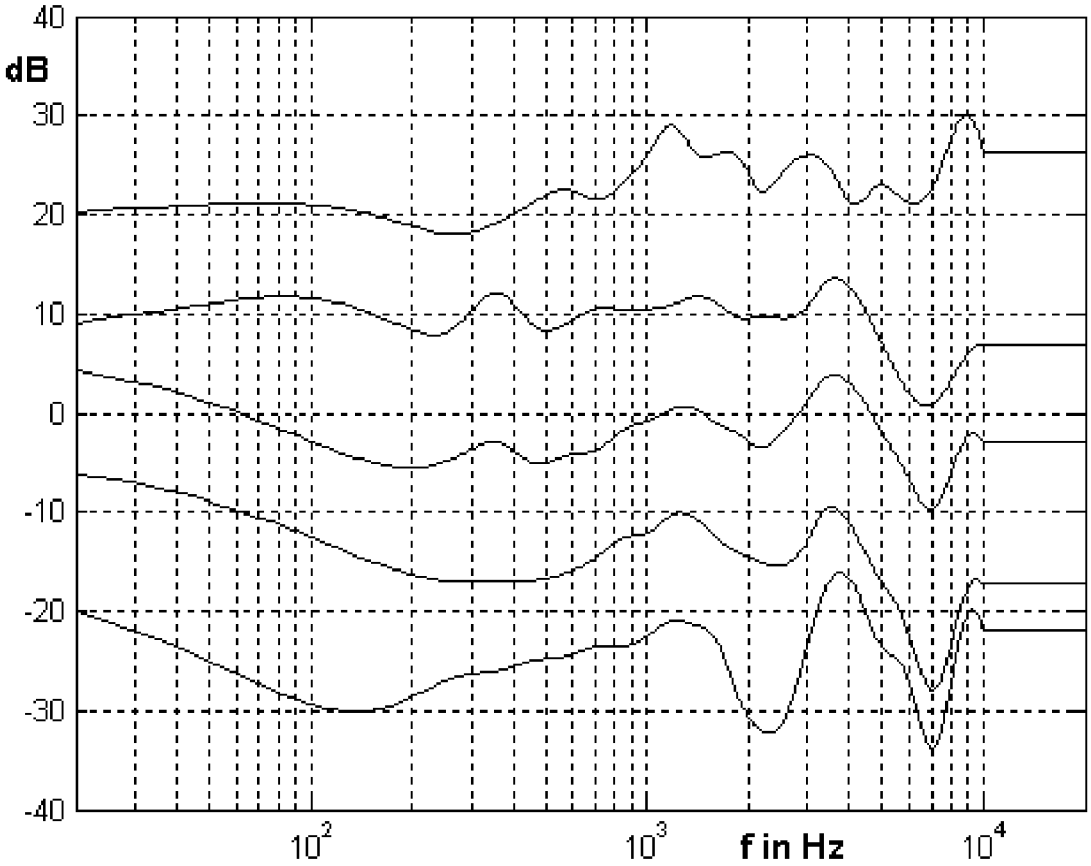
FIG. 15 is an example of filter response curves of respective head phone correction filters generated by a multiple users from user specific audio tests of a single headphone.

Since each headphone may provide a different response, a user may end up with significantly different headphone correction filters for different types of headphones. FIG. 14 is an example of a number of different headphone correction filters for different respective headphones as tested by a single person. In FIG. 14, a first curve 1402 may represent a headphone correction filter for a first in-ear style of headphone, a second curve 1404 may be for a full circumaural closed style of headphone, a third curve 1406 may be of a full-sized circumaural semi-open style of headphone, and a fourth curve 1408 may be for a second in-ear type of headphone. In this example, there are significant differences between the headphone correction filters, which all successfully enhanced sound quality. FIG. 15 is an example of the same headphone (full-size circumaural), measured by five different listeners in user specific tuning tests. The significant variations in the headphone correction filters for a single headphone confirm that the same headphone may yield very different headphone correction filters when tested by different persons.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A computing system comprising:

a processor;

a memory in communication with the processor, the memory comprising predetermined tone burst reference signals and predetermined tone burst test signals, the predetermined tone burst reference signals being at different audible frequencies from the predetermined tone burst test signals in each of a plurality of trial sets;

the processor configured to drive at least one headphone transducer sequentially and intermittently with one of the predetermined tone burst reference signals and a corresponding one of the predetermined tone burst test signals;

the processor configured to individually adjust a loudness of each of the predetermined tone burst test signals in response to receipt of a gain setting signal; and the processor configured to generate a headphone correction filter as a function of the adjusted loudness of each of the predetermined tone burst test signals.

2. The computing system of claim 1, where each of the tone burst reference signals are at a predetermined reference audible frequency, and the trial set of the tone burst test signals are each at a different predetermined test audible frequency in a range of test frequencies forming a frequency sub-band surrounding the predetermined reference audible frequency.

3. The computing system of claim 1, where audible frequencies of the tone burst test signals for a first tone burst reference signal included in a first trial set overlap with audible frequencies of a second trial set of the tone burst test signals for a second tone burst reference signal included in a second trial set.

4. The computing system of claim 1, where the processor is configured to capture and store the gain setting signal for each of the respective tone burst test signals, the processor further configured to generate a user based frequency response curve from a plurality of the captured and stored gain setting signals, the user based frequency response curve used in generation of the headphone correction filter.

5. The computing system of claim 4, where the processor is further configured to process the user based frequency response curve to form a continuous frequency response curve representative of the adjusted loudness of the respective tone burst test signals.

6. The computing system of claim 1, where the processor is configured to drive the at least one headphone transducer with each of the one of the predetermined tone burst reference signals and the corresponding one of the predetermined tone burst test signals in a sequence for a predetermined period of time in a predetermined order.

7. The computing system of claim 1, further comprising a user interface, the gain setting signal received from the user interface.

8. The computing system of claim 1, where the headphone correction filter is configured to filter an audio signal to customize the audio signal for a particular listener.

9. The computing system of claim 8, where the audio signal is further customized by the headphone correction filter to equalize the audio signal to drive a predetermined transducer included in a predetermined headphone.

10. A method of generating a headphone correction filter, the method comprising:

generating a sequence of predetermined tone burst reference signals from among a stored set of predetermined tone burst reference signals with a processor;

generating a respective corresponding predetermined tone burst test signal with the processor in response to generation of each of the predetermined tone burst reference signals, the respective corresponding predetermined tone burst test signal generated from among a stored set of predetermined tone burst test signals;

receiving, with the processor, a gain setting signal corresponding to each respective predetermined tone burst test signal in the stored set of predetermined tone burst test signals;

adjusting a loudness of the generated predetermined tone burst test signal corresponding to each of the predetermined tone burst reference signals with the processor based on the received gain setting signal;

storing an indication of the gain setting signal corresponding to the respective predetermined tone burst test signal in a memory; and generating a headphone correction filter with the processor as a function of the stored gain setting signal for each of the stored set of predetermined tone burst test signals.

11. The method of claim 10, where the stored set of predetermined tone burst reference signals and the stored set of predetermined tone burst test signals each have a different audio frequency forming part of a frequency range.

12. The method of claim 10, where each of the predetermined tone burst reference signals are at a predetermined reference audio frequency, and the respective corresponding predetermined tone burst test signal is at a predetermined test audio frequency surrounding the predetermined reference audio frequency.

13. The method of claim 10, where generating the respective corresponding predetermined tone burst test signal comprises generating a plurality of respective corresponding predetermined tone burst test signals in a frequency sub-band surrounding each of the predetermined tone burst reference signals, where different frequency sub-bands surround each of the predetermined tone burst reference signals.

14. The method of claim 10, where generating a headphone correction filter comprises forming a user based frequency response curve over a predetermined frequency range based on each gain setting signal corresponding to each respective predetermined tone burst test signal in the stored set of predetermined tone burst test signals, and generating the headphone correction filter from the user based frequency response curve.

15. The method of claim 10 further comprising performing a first trial with the processor that includes generating a first one of the predetermined tone burst reference signals to drive a headphone transducer, followed in a sequence by generating a first one of the predetermined tone burst test signals to drive the headphone transducer, and receiving, with the processor, a first gain setting signal corresponding to the first one of the predetermined tone burst test signals.

16. The method of claim 15 further comprising performing a second trial with the processor following the first trial, in the second trial generating a second one of the predetermined tone burst reference signals to drive the headphone transducer, followed by generating the first one of the predetermined tone burst test signals to drive the headphone transducer, and receiving, with the processor, a second gain setting signal corresponding to the first one of the predetermined tone burst test signals.

17. The method of claim 16, further comprising interpolating the first gain setting signal and the second gain setting signal to form a user based frequency response curve.

18. The method of claim 15 further comprising performing a second trial with the processor following the first trial, in the second trial generating the first one of the predetermined tone burst reference signals to drive the headphone transducer, followed by generating a second one of the predetermined tone burst test signals to drive the headphone transducer, and receiving, with the processor, a second gain setting signal corresponding to the second one of the predetermined tone burst test signals.

19. A tangible non-transitory computer readable storage medium configured to store a plurality of instructions executable by a processor, the computer readable storage medium comprising:

instructions executable by the processor to drive a headphone transducer with a first predetermined tone burst reference signal provided at a first frequency;

instructions executable by the processor to drive the headphone transducer with a first predetermined tone burst test signal provided at a second frequency different from the first frequency;

instructions executable by the processor to adjust a loudness of the first predetermined tone burst test signal in response to receipt of a first user gain setting;

instructions executable by the processor to drive the headphone transducer with a second predetermined tone burst reference signal provided at a third frequency different from the second frequency;

instructions executable by the processor to drive the headphone transducer with a second predetermined tone burst test signal provided at a fourth frequency different from the first frequency and the third frequency;

instructions executable by the processor to adjust a loudness of the second predetermined tone burst test signal in response to receipt of a second user gain setting; and instructions executable by the processor to generate a headphone correction filter based on the first user gain setting and the second user gain setting.

20. The tangible non-transitory computer readable storage medium of claim 19, where the second frequency and the fourth frequency are a same frequency, and the tangible computer readable storage medium further comprises instructions executable by the processor to interpolate the first user gain setting and the second user gain setting to generate a user based frequency response curve used to generate the headphone correction filter.

21. The tangible non-transitory computer readable storage medium of claim 20, further comprising instructions executable by a processor to at least one of smooth and gain limit the user based frequency response curve prior to generation of the headphone correction filter.

22. The tangible non-transitory computer readable storage medium of claim 20, further comprising instructions to determine if a difference in the first user gain setting and the second user gain setting exceeds a predetermined deviation threshold, and instructions to provide an indication to a user in response to the predetermined deviation threshold being exceeded.

23. The tangible non-transitory computer readable storage medium of claim 19, where the first frequency and the third frequency are a same frequency, and the tangible computer readable storage medium further comprises instructions executable by the processor to generate one of a plurality of segments of a user based frequency response curve used to generate the headphone correction filter from the first user gain setting and the second user gain setting.

24. The tangible non-transitory computer readable storage medium of claim 19, further comprising instructions executable by a processor to pre-filter the first and second predetermined tone burst test signals with an equal-loudness filter before the headphone transducer is driven by the first and second predetermined tone burst test signals.

* * * * *